United States Patent [19]

Brown et al.

[11] 4,044,943

[45] Aug. 30, 1977

[54] CENTRIFUGAL SEPARATOR AND SYSTEM

[75] Inventors: Francis Barton Brown, La Crescenta; John W. Erickson, Huntington Beach, both of Calif.

[73] Assignee: Kobe, Inc., Huntington Park, Calif.

[21] Appl. No.: 697,987

[22] Filed: June 21, 1976

[51] Int. Cl.[2] ..... B04B 1/12; B04B 11/02

[52] U.S. Cl. ..... 233/19 A; 233/21; 233/32; 233/46; 415/89

[58] Field of Search ..... 233/19 R, 19 A, 20 A, 233/21, 22, 27, 46, 47 R; 415/89

[56] References Cited

U.S. PATENT DOCUMENTS

| | | | |
|---|---|---|---|
| 2,760,889 | 8/1956 | Peltzer | 233/21 X |
| 3,126,337 | 3/1964 | Smith | 233/19 R |
| 3,623,657 | 11/1971 | Trump | 233/19 A |
| 3,817,446 | 6/1974 | Erickson | 233/21 X |
| 3,977,810 | 8/1976 | Erickson | 233/21 |

*Primary Examiner*—George H. Krizmanich
*Attorney, Agent, or Firm*—Christie, Parker & Hale

[57] ABSTRACT

A constant flow rate input fluid of mixed gas, oil, water and suspended solids separates into its phases by centrifuging in a chamber of a multiple phase separator. Clean oil draws off through a mouth of a pitot tube tap which extends into the chamber. Solids leave the chamber through radially perimetric orifices. Water leaves the chamber through a radial passage opening into the chamber radially inward of the orifices and outward of the mouth of the pitot tube. Gas leaves the chamber through an annular tap radially inside the mouth of the pitot tube. An overflow oil stream leaves through this annulus and keeps separate from the gas by gravity. The quantity of water in the chamber determines the radial positions of the lighter constituents of oil and gas so that each tap for these phases draws only the proper phase. Insufficient water in the chamber reduces the water flow rate from the separator, which generates a signal that recirculates water from a reservoir into the separator to increase the quantity of water there. Too much water increases the water flow rate from the separator. Too little oil results in stoppage of the overflow oil stream. When the latter flow stops, oil flow from the pitot tube stops to allow the input fluid to increase the percentage of oil in the chamber. The overflow annulus is sufficiently capacious to drain excess oil without further phase adjustment.

25 Claims, 2 Drawing Figures

GAS OUTLET
PRODUCTION FLUID INLET
CLEAN OIL OUTLET
EXCESS OIL OUTLET
CLEAN WATER OUTLET
DIRTY WATER AND SOLIDS OUTLET
WATER
OIL
OIL
GAS

CENTRIFUGAL SEPARATOR AND SYSTEM

BACKGROUND OF THE INVENTION

The present application relates to pitot tube separators for mechanically mixed fluids and solids, and to such separators and systems especially useful in petroleum recovery from wells where produced oil is the working fluid in down-in-the-well pumps.

Production oil from petroleum wells has been used as the power fluid or petroleum pumps located in the wells in petroleum recovery zones. The oil is from a production fluid typically of oil, gas, water and solids. Before the oil of this fluid can be used as the power fluid, the water, gas and solids must be removed.

"Three-phase" centrifugal separators separate production fluid into the phases of solid, water, oil and gas. The separated oil is of adequate purity to serve as the power fluid for the petroleum pumps. Known three-phase centrifugal separators include a rotor driven in rotation in a housing. A chamber in the rotor receives input fluid and subjects that fluid to centrifugal force. The differences in the constituent fluid densities stratifies the fluid into zones with the heaviest fluid being the furthest from the axis of rotation of the rotor and the lightest at the axis of rotation. The solid constituents also separate in accordance with their density, but a practice has been to take the separated solid off with a carrier liquid. The carrier liquid is taken from one of the liquid phases and may be water, for example. After the zone at the axis, the remaining constituent zones are annular, doughnut shaped. Appropriate taps draw the separated phases from the rotor.

Pitot tube pumps with centrifugal separators use a pitot tube in the chamber of a rotating casing to intercept and draw off liquid. Interception is at a fixed radial zone relative to the axis of rotation of the casing. Solids pass through nozzles opening at the radial perimeter of the casing. U.S. Pat. No. 3,817,446 describes such a pump and separator.

The relative amounts of each of the phases of production fluid can vary. The tap for the oil phase will draw off gaseous phase fluid if the water phase in the rotor drops too much and permits the oil phase to move radially outward in the rotor and away from the oil tap. This is undesirable. If the fraction of water phase drops off and the fraction of oil increases, oil can be the only phase seen by the oil tap. Too much oil, however, can result in oil coming off the water tap in an exceptional case. The increase in oil can be at the expense of gas, in which case the increased oil fraction can exit a rotor through the gas tap and provisions must be made for this possibility.

U.S. Pat. No. 3,960,319 describes a multiple phase separator and a technique for assuring the maintenance of the distinct zonal phases in the separator. The separator has a rotor for centrifuging and a pitot tube tap for taking off an oil phase. The technique maintains the pressure in a water zone of the separator and supplies makeup water to this zone in the event that the pressure drops, and permits loss of water from the zone when the pressure increases. This maintains a constant radial position of a water-oil interface and the oil behind the interface within a radial zone that includes the oil tap.

SUMMARY OF THE INVENTION

The present invention provides a centrifugal separator for multiple phase fluids having a rotor with a centrifuging chamber therein. Means rotatably mount the rotor in a housing. Means supply a fluid to the rotor chamber, such fluid being, for example, production fluid from a petroleum well. A pitot tube tap has a mouth in the chamber at a selected radial zone therein to draw off a fluid at that zone. The pitot tube is part of an assembly which defines a passage from the mouth, preferably along the axis of the separator. At a radial zone interiorly of the mouth of the pitot tube a passage provides passage for a second phase of fluid from the centrifuging chamber and an overflow passage for the phase of fluid which passes through the pitot tube passage. Preferably this passage empties into an auxiliary chamber wherein gravity separation of two phases exited through the passage can take place. Radially of the outside of the mouth of the pitot an exit passage for a third phase opens into the centrifuging chamber and preferably passes radially inward from its opening towards the axis of rotation of the rotor so that fluid in it will be opposed by centrifugal force. A fourth exit passage radially outward of the third takes off a fourth phase of material, say solids, in a liquid carrier. This fourth passage may be a plurality of perimetrically disposed exit orifices radially outward of the entrance to the third phase passage.

Features of the separator of the invention include straightening vanes within the rotor chamber to limit axial movement of fluid and an agitator to turbulize the fluid at the entrance to fourth phase exit orifices and prevent their clogging. Both the pitot tube passage and the third phase fluid passage pass fluid in opposition to centrifugal force. Therefore a positive control head exists for these phases. A housing containing the rotor itself define a gravity separator for the annulus which is radially inward of the mouth of the pitot tube. The housing also defines a part of the passage for the third phase of fluid and an annulus for the collection and passage of fourth phase fluid.

The present invention provides a centrifugal separator system for multiple phase fluids wherein adjustments to the relative amounts of the separated phase can be made within the separator to assure the purity of at least one phase notwithstanding changes in the relative amounts of the constituents of the unseparated fluid. A stationary fluid pickup placed at a radial location will always receive the chosen constituent. In a practical application, the phase of concern primarily is oil used as the power fluid in a well and separated from a makeup of production fluid of gas, oil, water and solids. The fluid pickup is a pitot tube in a chamber of a rotor at a radial position to intercept oil which has a density between oil and gas and occupies an intermediate position between the two when centrifuged.

Broadly, the separator system of the invention contemplates a centrifugal separator for separating multiconstituent feed which includes a rotor in a housing. A rotor chamber within the rotor receives feed, say production fluid from a petroleum well through passage means. Exit taps or passages from the rotor chamber are radially located to stratify by centrifugal force constituents in desired zones. A control constituent in a zone of large radius has its flow rate from the chamber sensed. When the flow rate of the control constituent is not adequate to maintain a desired radial position of a second, controlled constituent at a smaller radius, the exited first constituent is recirculated. This adjusts the relative fractions of the control and controlled fluids in the chamber to within predetermined limits.

The control fluid itself acts as a control. A sensor senses flow of control fluid through an overflow passage which opens into the chamber radially inward of a primary exit tap of the control fluid. When overflow fluid reaches a predetermined low flow rate, as when it stops, the sensor slows or stops flow of control fluid through the primary tap. This effects an adjustment of the relative quantity of the phases in the rotor chamber.

A particular form of the present invention contemplates a centrifugal separator having a rotor in a housing and a chamber in the rotor. An input fluid passage into the chamber provides multiphase fluid for separation into its phases. Access from the chamber at different radial positions permits drawing from the chamber separated phases of the fluid of different densities, with the most dense phase being drawn off at the largest radius and the lightest phase being drawn off at the shortest radius. Preferably, a pitot tube in the chamber provides the means for drawing off a select one of the phases, say oil, through a mouth radially positioned to intercept the select phase. The mouth connects to an outlet of the separator through an axial passage. A plurality of orifices at maximum chamber radius exits the most dense phase, say solids of a solid phase. These orifices are constructed so as not to pass all the phases. An agitator vane creates local turbulance in the vicinity of these orifices to prevent their clogging. A third outlet tap radially between these orifices and the pilot tube mouth draws another phase from the chamber, say water. This phase typically will be the heaviest phase occupying a distinct zone in the rotor chamber and the quantity of this phase in the chamber will, therefore, determine the radial position of the phases radially inside it. This outer phase can be called a control phase. The control phase outlet can supply, through a passage, a weir annulus having a radius less than the control outlet tap, say at about the vicinity of the mouth of the pitot tube. This weir passes its fluid into an annular cavity of the housing from which the fluid passes at a convenient exit. An innermost exit, say for gas, at a radius less than the radius of the pitot tube mouth draws the lightest phase from the chamber. This exit also takes overflow fluid from the next adjacent phase, which is the select phase that takes off from the chamber through the pitot tube. The separator rotor has its axis of rotation horizontal and this permits the separation of the excess select phase from the lightest phase by gravity, and an excess select phase exit in the housing of the separator draws this fluid from the separator.

A makeup system externally of the separator includes a control phase plenum which collects the control phase from the separator. The level of this phase in this plenum directly measures the relative quantity of the phase admitted through the fluid intake and, accordingly, the radial position of the select phase-lightest phase interface within the chamber of the rotor. When the control phase quantity in the plenum drops, means sense the drop and recirculate the control phase from the plenum into the fluid intake of the separator to augment the control phase supply by the input fluid and drive the select phase-lightest phase interface in the rotor chamber to a radially smaller value and maintain pure select phase at the mouth of the pitot tube pickup.

Flow of select phase through the innermost radial exit is preferably sensed and when the flow rate of select phase through the exit falls below the predetermined level, say it falls to zero, then the sensor operates valve means in the select phase discharge from the pitot tube to reduce or eliminate select phase flow through the tube. This permits select phase build up in the chamber.

These and other features, aspects and advantages of the present invention will become apparent from the following description, appended claims and drawings.

DESCRIPTION OF THE PREFERRED EMBODIMENTS

Figure 1:
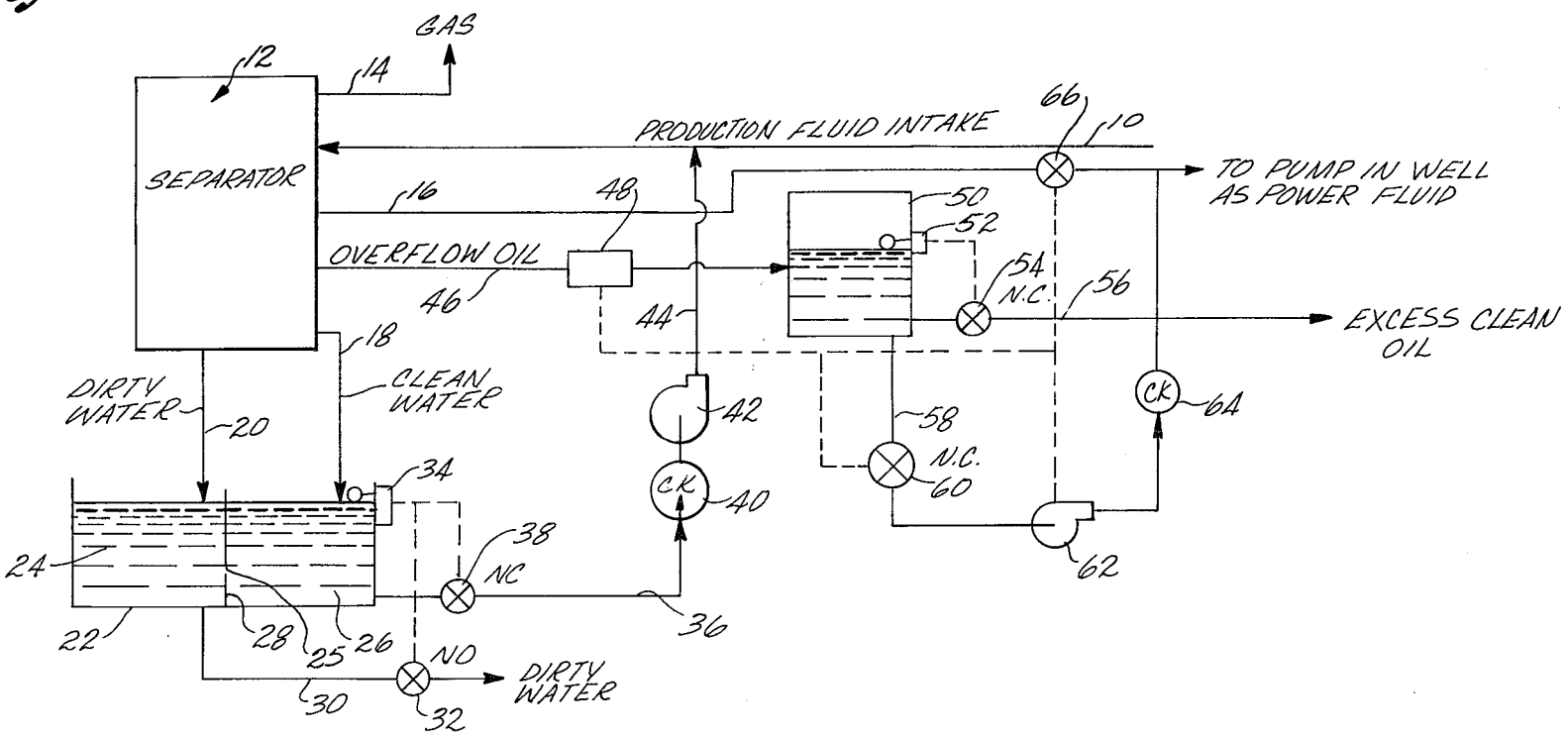
FIG. 1 illustrates by a line schematic the preferred separator and separator system of the present invention.

In FIG. 1, a production fluid line 10 from a petroleum well contains four phases of material. These phases are gas, oil, water and solids. The production fluid is pumped to the surface and into line 10 by a deep well pump located in the petroleum recovery zone of the well. Some of the oil from the production fluid provides the power fluid for the pump located down in the well. This power fluid oil should be comparatively pure and free of the other phases of production fluid.

A separator 12 forms the clean oil power fluid by centrifugal separation. Centrifugal separation relies on the density differences between the phases. Gas leaves the separator by line 14. Clean oil leaves the separator by line 16. Clean water leaves the separator by line 18. Dirty water and solids leave the separator by line 20.

A reservoir 22 receives the flow from lines 18 and 20. The reservoir has a compartment 24 and a compartment 26, both formed by a partition 28 which separates dirty water from clean water. Dirty water effluent discharges into compartment 24 and clean water effluent discharges into compartment 26. Dirty water has that character because of the presence in it of the solid phase. This phase comes out of suspension by gravity and accumulates at the bottom of compartment 24, a hole 25 communicates the clean and dirty water compartments so that water in both is at the same level. The hole is above the level of normal solid accumulation in compartment 24.

Dirty water exits from compartment 24 through a line 30 and a normally open valve 32 in the line. This valve is controlled by a float switch 34 which senses the level of water in reservoir 22. Line 36 from compartment 26 contains a normally closed valve 38 to control the flow of clean water through the line. A check valve 40 in line 36 prevents backflow of fluid through this line into compartment 26. Valve 38 is also controlled by float switch 34. When the liquid level in compartment 26 drops sufficiently, switch 34 closes, activating a circuit to normally open valve 32, which closes that valve, and a circuit to normally closed valve 38, which opens that valve. The closing of switch 34 also energizes an electric motor to pump 42 so that the pump operates. Water then can accumulate in dirty water compartment 24 and can be drawn from compartment 26 through line 36. Line 36 is in series circuit with a pump 42 which, through a line 44, can supply production fluid intake line 10 with water from reservoir 22. Pump 42, then, provides water to production fluid intake line 10 from compartment 26.

As will become apparent, the interfaces between the water and oil phase in separator 12 can move radially depending entirely on the quantity of water in a rotor of the separator radially outside the oil in the rotor. The water is denser than the oil and prevents the oil from moving radially outward. The oil pickup is stationary and therefore whether it sees oil can depend on the quantity of water in the rotor chamber radially outside the oil. When insufficient water in the rotor exists, the level of water in reservoir 22 drops and makeup water to the separator input flows from the reservoir to maintain the correct amount of water in the rotor.

Any overflow of oil from separator 12, that is, oil in addition to the oil flowing in line 16, leaves the separator through a line 46. A sensor 48 in line 46 senses the flow of oil in that line of control downstream equipment in a manner to be described. Overflow oil in line 46 discharges into holding vessel 50. Any gas in the overflow oil occupies an upper gas zone of the vessel and the oil itself occupies the lower zone, as indicated. A float switch 52 gauges the level of oil in this vessel. When the level of oil increases beyond a prescribed level, switch 52 closes a circuit to a valve 54 on an excess flow line 56. The valve responds by opening, and oil flowing through line 56 drops the level of oil in vessel 50 until switch 52 senses a set low level and closes valve 54. A line 58 having a normally closed valve 60 draws excess oil from vessel 50 in response to a signal from sensor 48 that the flow of oil in line 46 has dropped to a prescribed low level, say zero. The signal energizes a circuit to valve 60 which opens the valve. A pump 62 in line 58 also operates in response to the same signal from sensor 48 to pump oil through the line and into line 16. A check valve 64 in line 58 prevents flow from line 16 through line 58. A normally open valve 66 in line 16 responds to the signal of sensor 48 that the flow in line 46 is at the prescribed low level and closes. This forces an increase in the oil in the separator and a discharge of oil out through line 46. Sensor 48 will sense the flow of the oil in line 46. As a consequence, valve 60 will close, pump 62 will stop, and valve 66 will again open.

Figure 2:
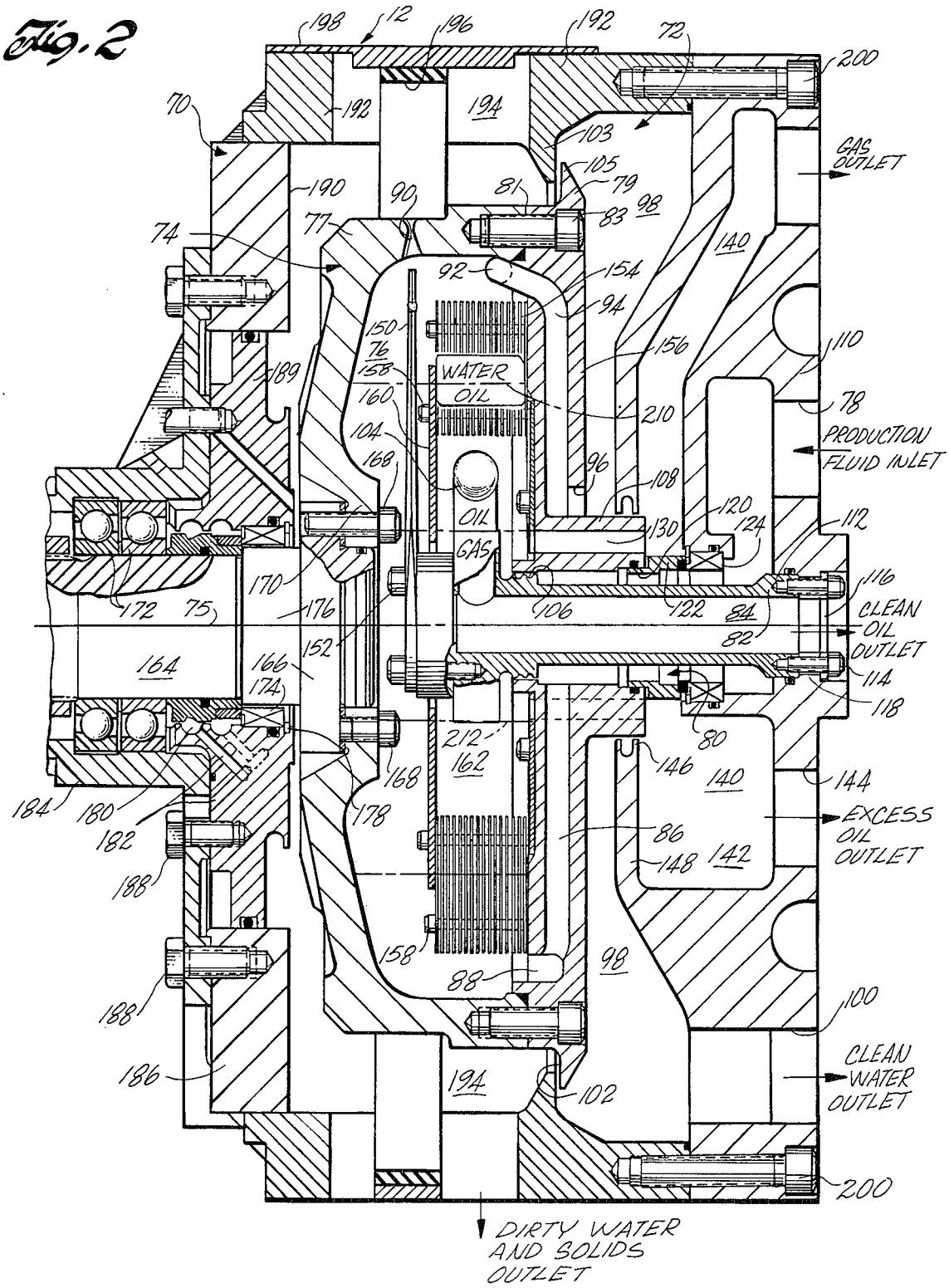
FIG. 2 illustrates in elevational cross section the preferred separator.

FIG. 2 illustrates the preferred centrifugal separator 12. An outer housing 70 of multipiece construction defines an inner space 72 for a rotor 74. The rotor is driven in rotation by a prime mover (not shown). The rotor has a horizontal axis of rotation 75. A chamber 76 within the rotor provides a volume for centrifugal separation of the phases of the production fluid and a place for the fluid to receive the energy necessary to effect the centrifugal action on it.

Rotor 74 has a deeply hollowed drum 77 closed by a radially oriented lid 79 which meets the drum at a circular joint 81. The lid and drum fasten together through male fasteners 83 and together define chamber 76.

Production fluid intake 78 from line 10 (FIG. 1) communicates with chamber 76 through an annular passage 80 outside of an annular wall 82 of a clean oil exit passage 84. Passage 84 couples directly with line 16 (FIG. 1). Passage 80 feeds radial passage 86 which exits into chamber 76 at horizontal port 88. Thus production fluid reaches the interior of rotor 74. A plurality of orifices 90 in the outer radial wall of rotor 74 provide for exits of water dirtied by contaminant solid phase material. A circumferentially opening inlet port 92 supplies a radial passage 94 from a point of relatively large radius in chamber 76 to an annular exit port 96. Discharge from port 96 enters annulus 98 and leaves the separator through port 100, which connects with line 18 (FIG. 1). Annulus 98 seals from the balance of the interior of the housing at annular, rotary seal 102. This seal defines from radially overlapping circular flanges 103 and 105 of the housing and rotor, respectively. In use, passage 94 passes clean water from the rotor. Water in passage 94 is resisted by centrifuged force, which resistance provides positive constraint or control on water flow.

A pitot tube 104 has a mouth which faces fluid rotating about axis 75 in chamber 76 and is in a zone to be occupied by oil. The pitot tube receives oil from this zone and passes the oil into passage 84. Passage 84 connects to line 16 (FIG. 1). Pitot tube 104 caps a pitot assembly which includes the pitot tube and the passage. This assembly also has an exterior seal 106 between it and a hub 108 of the rotor. Seal 106 prevents production fluid in passage 80 from entering chamber 76 in a zone reserved for gas. The assembly attaches to a cover 110 of the housing remote from the chamber and proximate the entrance of the production fluid inlet. Attachment is at a flange 112 of the assembly. This flange receives male fasteners 114, which in turn bear through a washer 116 on an external side of an annular flange 118 of cover 110. Flange 112 bears on the interior side of flange 118.

On the right side of rotor 74 as viewed in FIG. 2, hub 108 of rotor 74 receives an annular nose 120 of a ring 122, which is concentric with axis 75. The ring axially engages a seal ring 124 located in a bearing recess of cover 110. Hub 108 defines a plurality of passages 130 parallel to axis 75 between chamber 76 and a cavity 140. Cavity 140 feeds line 14 with gas separated from incoming mixture.

Passages 130 also pass any overflow oil forced there by accumulation of oil and water in chamber 76 of sufficient quantity to place the oil-gas interface at a radius within the entrance to passage 130. This overflow condition represents the normal condition of the system. Overflow oil collects in a base 142 of the cavity for overflow out exit 144 and into line 46 (FIG. 2). A rotary seal 146 between hub 108 and a radially extending annular wall 148 bounding cavities 98 and 140 keeps the fluids within these cavities separate.

Chamber 76 contains an agitator vane 150 affixed through male fasteners 152 to the pitot tube assembly. This agitator creates turbulence local to exit orifices 90 which prevent their clogging with the sand, sediment and the like, which material constitutes the solid phase of the production fluid inlet mixture.

A stack of straighteners 154 have radial interstices between them to flow fluid and solids radially of axis 75. The stack reduces fluid motion to purely radial and circular and promotes separation of constituent phases of input mixture. The stack attaches to a cover 156 of the rotor as by male fasteners 158. A cover 160 affixed to the stack forms an annular shroud 162 for pitot tube 104.

Rotor 74 secures to a drive axle 164 at a hub 166 of the latter through male fasteners 168 acting against a circular mounting flange 170 of the rotor. Axle 164 journals in bearings 172. A seal ring 174 receives a step 176 of the axle and is retained in place by clip retainer 178. Seal 180 blocks leakage through the axle's passage. Weep holes 182 relieve the seal and drain externally of the housing.

Bearing housing 184 secures to a housing wall 186 as through fasteners 188. Housing wall 186 is formed of radial segments 189, 190 and 192. An external cavity 194 has an annular rubber bumper 196 against which centrifuged solid matter impinges. This reduces the eroding effect of solid material against the wall of the housing of the separator. The annular bumper rings the inside wall of a circular cover ring 198 of the housing which itself secures to radial segment 192. Segment 192 extends axially to cover 110 to which its attains through male fasteners 200.

Solid material falls to the bottom of cavity 194 by gravity after its kinetic energy has been exhausted and it leaves the cavity with water also exited through orifices 90 for collection in compartment 24 of reservoir 22.

During normal operation, production fluid flows through line 10 from a petroleum well. This fluid is fluid from a producing zone of the well, and, possibly, exhausted power fluid of the deep well pump. The fluid is a mixture of solids, oil, water and gas. This mixture enters separator 12 at port 78. Port 78, through passage 80 and radial passage 86, empties into chamber 76 of the rotor of the separator. The constituents of the mixture all have different densities and, accordingly will separate into radial zones in accordance with their density under the influence of a centrifugal force field. The zonation places the most dense material in the outer radial zone with progressively less dense materials occupying zones of smaller radius. The outer zone will be for dirty water and sand. The next zone will be for water. The water of these two zones obviously intermix, the solids tending to stay to the radial outside zone because of their greater density. Oil and water form an annular interface at, say, 210 which defines the outer radial boundary of a doughnut-like annular zone of clean oil. The inner boundary of the oil is determined by axial passages 130. The inner boundary is indicated by reference numeral 212. Within this inner boundary, a zone for the lightest of the phases, gas, is defined. Gas exits through passages 130, cavity 140, and out of the separator for collection. Clear oil enters the mouth of pitot tube 104 and passes out axial passage 84 and into line 16.

The flow of production fluid in line 10 will be determined by the deep well pump and not by separator 12. The flow rate of each constituent of the stream can vary, however, so long as the flow rate of all the constituents remains the same. With drop in the water content of stream 10, the content of oil, or gas, or both of the stream increases. In response interface 210 would move radially away from axis 75, absent correction. Assuming no correction, interface 210 moves to larger and larger radii. Eventually interface 212 follows and moves into the radial limits of the mouth of pitot tube 104. Discharge from the pitot tube will then be gas as well as oil, and this is not desired, for the oil forms the power fluid of the deep well pump and only a modest amount of gas is acceptable in this application. The occurrence of an inadequate amount of water in the chamber to maintain the oil in the bounds of the desired annular zone is determined by reservoir 22. Flow rate out of the reservoir and the flow rate into the reservoir are normally the same, so the level of the tank is constant. This flow rate into and out of the reservoir corresponds to the expected input of water into the separator from the petroleum well. If the separator does not separate out enough water, however, the flow rate into the tank will drop and float level switch 34 will open valve 38 and close valve 32. The opening of valve 38 introduces water from the reservoir into the separator through lines 36, 44 and line 10, with a boost in head by pump 42. With this augmented supply, water in the outer radial zone of chamber 76 will be sufficient to force interface 212 between the oil zone and the gas zone into the desired region to present essentially oil to the mouth of the pitot tube.

More in particular, when the water fraction in line 10 decreases and the gas content in the line makes up the decrease, interface 212 moves radially outward and away from passages 130. This stops the flow of oil out passages 130 and stops the flow of oil through line 46. Sensor 48 senses this fact and sends a signal which closes valve 66, opens valve 60 and energizes pump 62. The closing of valve 66 stops oil flow through line 16 and permits the build up of the oil fraction in separator 12 from what oil is provided from line 10. With valve 60 open and pump 62 energized, oil from vessel 50 supplies line 16 downstream of valve 66 and, thus, the deep well pump continues to be supplied with power fluid.

When the water fraction in line 10 decreases and the oil content in the line makes up the decrease, oil flows in line 46 and oil to the production pump will continue to be supplied by the separator through line 16.

When the water fraction in line 10 increases, the head of the water in the separator increases. With increase in head, water will flow out of the separator faster, adjusting the position of interface 212.

When the oil in line 10 increases and the water content remains the same, oil continues to flow through lines 16 and 46 and no external adjustments to the content of the separator are made. When the oil in line 10 decreases and the water content remains the same, the flow in overflow line 46 stops initiating the closing of valve 66 and the supply of the deep well pump by oil from vessel 50. The closure of valve 66 permits the build up of the fraction of oil in the separator.

When the level of oil in vessel 50 gets too large, float switch 52 opens valve 54 and oil is drained from the vessel.

The present invention has been described with reference to a certain preferred embodiment. The spirit and scope of the appended claims should not, however, necessarily be limited to the foregoing description.

What is claimed is:

1. In a centrifugal separator for separating the phase constituents of a multiconstituent feed of solid, liquid and gaseous phases, an improvement which comprises:

a. a housing;

b. a rotor rotatable in the housing and having a rotor chamber;

c. passage means for delivering the multiconstituent feed to the rotor chamber;

d. means to define radial zones of mixture phase constituents stratified in accordance with their density and in response to centrifugal force applied through the rotor, such means including exit passages from the rotor chamber for the individual phase constituents of the feed, the exit passages including a pitot tube having a mouth in the chamber at a selected radial zone therein for a select one of the phases, a plurality of constructed passages opening at the radial perimeter of the chamber for the solid phase, and a control fluid passage opening into the chamber between the constricted passages and the pitot tube for a control phase liquid of the phases, whereby the quantity of control phase liquid in the chamber determines the radial position of the other non-solid phases in the rotor chamber.

2. The improvement claimed in claim 1 wherein the exit passage for the control liquid includes a radial passage having an inlet port of major radius providing the opening therefor into the chamber, and an exit port of minor radius, whereby centrifugal force resists flow of the control liquid in the radial passage and stabilizes the flow therethrough.

3. The improvement claimed in claim 1 wherein the exit passages include a passage for the gas phase which opens into the chamber at a radius less than the radius of the mouth of the pitot tube.

4. The improvement claimed in claim 3 wherein the exit passage for the gas phase serves also as an overflow passage for the select one of the phases, and including a cavity in the housing in communication with the exit passage for the gas phase and capable of separating by gravity the gas and the select phase, a first outlet from the housing opening into the cavity for exiting the gas phase, and a second outlet from the housing opening into the cavity for exiting the select phase, the first and second outlets opening into the cavity at vertically spaced locations.

5. The improvement claimed in claim 4 including a plurality of radial vanes radially outward of the pitot tube to reduce movement of fluid in the chamber in the axial direction, the radial vanes being mounted on the housing.

6. The improvement claimed in claim 5 including an agitator vane mounted on the housing and disposed in the chamber proximate the constricted passages to create local turbulence and prevent the constricted passages from clogging with solid phase constituent.

7. A centrifugal separator comprising:

a. a housing;

b. a rotor rotatably mounted in the housing;

c. the rotor having a rotor chamber defined by a deeply dished drum and a lid closing the drum;

d. input passage means into the chamber for a multiconstituent feed of solid, liquid and gaseous phases, the input passage means emptying into the chamber at a location proximate the radial perimeter thereof;

e. means to define radial zones of mixture phase constituents stratified in accordance with their density in response to centrifugal force applied through the rotor and to the relative quantities of the constituents in the chamber, such means including:

i. a pitot tube assembly for taking from the chamber a select one of the phase, the pitot tube assembly being mounted on the housing and having a pitot tube mouth in a selected radial zone for presentation to the selected one of the phases in the chamber and a first passage from the mouth to outside the separator for exiting the selected phase from the separator;

ii. a second passage opening into the chamber at a radius less than the radius of the pitot tube mouth and exiting from the separator, the second passage being for exiting a second of the phases;

iii. a third passage opening into the chamber at a radius greater than the radius of the pitot tube mouth and exiting from the separator, the third passage being for exiting a third of the phases; and iv. a fourth passage opening into the chamber at a radius greater than the radius of the third passage opening, the fourth passage exiting from the separator being for exiting a fourth and solid phase of the phases.

8. The centrifugal separator claimed in claim 7 wherein:

a. a first section of the first passage extends along the axis of rotation of the rotor and a second section of the first passage extends generally radially outward from the first section to the mouth of the pitot tube;

b. the third passage includes a section extending radially inward from its opening into the chamber in the rotor and exiting from the rotor at a radius less than the radius of the opening of the third passage into the chamber; and c. the fourth passage includes a plurality of constricted orifices opening into the chamber at the radial periphery thereof.

9. The centrifugal separator claimed in claim 8 wherein:

the second passage is for exiting overflow select phase as well as second phase and includes a cavity in the housing having first and second vertically spaced apart outlets, the cavity being sufficiently capacious to separate by gravity second phase and selected phase, the lower of the first and second outlets being for select phase and the upper of the first and second outlets being for the second phase.

10. In a centrifugal separator for separating the constituents of a multiconstituent feed, an improvement which comprises:

a. a housing;

b. a rotor rotatable in the housing and having a rotor chamber;

c. passage means for delivering multiconstituent feed to the rotor chamber;

d. means to define radial zones of mixture constituents stratified in accordance with their density and in response to centrifugal force applied through the rotor, such means including exit passages from the rotor chamber for the individual constituents of the mixture;

e. means to sense the flow rate from the chamber of a first constituent at a radial zone having a radius larger than the radial zone of a second of the constituents;

f. accumulator means to accumulate first constituent exited from the rotor chamber; and g. means for introducing the first constituent from the accumulator means into the multiconstituent feed for recirculation when the output from the separator drops below a value adequate to maintain the second constituent in its radial zone, whereby the output of the first constituent controls the purity of the second constituent.

11. The improvement claimed in claim 10 including:

means to sense the flow rate from the chamber of the second constituent;

means responsive to the second constituent flow rate means upon sensing a predetermined low flow rate thereof to terminate second constituent discharge from the separator to thereby increase the second constituent in the chamber; and means responsive to the quantity of second constituent in the chamber reaching a predetermined value to establish second constituent discharge from the separator.

12. The improvement claimed in claim 11 wherein:

the exit passage for the first constituent includes a radial passage section in the rotor having an inlet port of major radius and an exit port of minor radius, whereby centrifugal force resists flow of the first constituent in the radial passage and stabilizes the flow therethrough.

13. The improvement claimed in claim 12 wherein the exit passage for the second constituent is a pitot tube.

14. The improvement claimed in claim 10 wherein the means for sensing the flow rate from the chamber of the first constituent includes the accumulator means, passage means from the accumulator means to exit the first constituent therefrom, and means to sense the level of first constituent in the accumulator, the level sensing means triggering the introduction means to introduce the first constituent into the multiconstituent feed for recirculation upon sensing a predetermined low level in the accumulator means.

15. The improvement claimed in claim 14 wherein:

the exit passage for the first constituent includes a radial passage in the rotor having an inlet port of major radius and an exit port of minor radius, whereby centrifugal force resists flow of the first constituent in the radial passage and stabilizes the flow therethrough.

16. The improvement claimed in claim 15 wherein the exit passage for the second constituent is a pitot tube.

17. The improvement claimed in claim 11 wherein the sensing means for the first constituent includes a float switch to sense the level of the first constituent in the accumulator means, and the introduction means includes pump means between the accumulator means and the multiconstituent feed, normally closed valve means between the accumulator means and the pump means controlled by the float switch to open when the predetermined low level exists in the accumulator means, check valve means to prevent flow of fluid from the pump means to the accumulator means, and normally open valve means in the passage means from the accumulator means controlled by the float switch to close when the predetermined low level exits in the accumulator means.

18. A centrifugal separator for separating a fluid mixture into constituent parts in accordance with different densities of the constituent mixtures comprising:

a. a housing;
b. a rotor rotatably mounted in the housing;
c. the rotor defining a chamber for receiving the mixture;
d. inlet passage means into the chamber to deliver the mixture to the chamber;
e. first passage means from the chamber including a first output port from the chamber at a first radius for a first dense constituent of the constituents;
f. second passage means from the chamber including a second output port from the chamber at a second radius smaller than the first radius for a second constituent of less density than the dense constituent;
g. third passage means from the chamber including a third output port from the chamber having a radius less than the second radius for a third constituent of the mixture of density less than the first and second constituents;
h. means for storing the first constituent externally of the chamber;
i. means for withdrawing first constituent from the storage means at a rate corresponding to the expected rate of first constituent input to the chamber; and
j. means for recirculating the stored constituent into the inlet passage when the level of the first constituent in the storage means reaches a predetermined low value, whereby the position of the second constituent in the chamber is maintained and the exit port for such constituent sees only such constituent.

19. The centrifugal separator claimed in claim 18 including:

a. overflow passage means from the chamber as an additional passage for the second constituent, the overflow passage means including an overflow output port from the chamber having a radius less than the radius of the second output port;
b. means to sense the flow of second constituent in the overflow passage;
c. means responsive to the second constituent sensing means to reduce the flow rate of the second constituent from the separator upon sensing a predetermined low flow rate of the second constituent in the overflow passage means and to reestablish the flow rate of the second constituent from the separator upon sensing a flow rate of the second constituent in the overflow passage means greater than the predetermined low flow rate therein.

20. The centrifugal separator claimed in claim 19 wherein:

the overflow passage means includes the third passage means and means to gravitationally separate overflow second constituent from third constituent.

21. The centrifugal separator claimed in claim 20 including:

accumulator means for the overflow second constituents; and means to discharge accumulated overflow second constituent upon reduction of the flow rate of the second constituent in response to the second constituent sensing means.

22. The centrifugal separator claimed in claim 21 including a radial passage in the rotor from the first outlet port from the chamber leading to an exit port having a radius smaller than the first outlet port, whereby centrifugal force resists flow of the first constituent in the radial passage and stabilizes the flow therethrough.

23. The centrifugal separator claimed in claim 22 including a pitot tube in the chamber and defining the second output passage therefrom, the second output port being into the pitot tube.

24. The centrifugal separator claimed in claim 23 wherein the inlet passage means opens into the chamber at a radius greater than the radius of the second outlet port.

25. The centrifugal separator claimed in claim 24 including a plurality of plates in the chamber with radially extending interstices between the plates, the plates being between the inlet passage means and the second outlet port and sufficiently close together to limit axial fluid mixing.

* * * * *

UNITED STATES PATENT AND TRADEMARK OFFICE

CERTIFICATE OF CORRECTION

PATENT NO. : 4,044,943

DATED : August 30, 1977

INVENTOR(S) : Francis Barton Brown
John W. Erickson

It is certified that error appears in the above-identified patent and that said Letters Patent are hereby corrected as shown below:

In the specification: Column 2, line 34, "define" should be --defines--; Column 2, line 41, "phase" should be --phases--; Column 3, line 25, "constructed" should be --constricted--; Column 3, line 28, "pilot" should be --pitot--; Column 5, line 12, "of" 2nd occurrence should be --to --; Col.6,line 31, "passage" should be -- passages --; Col. 7, line 1,"its attains" should be --it attaches--; Column 7, line 33, "Clear" should be --Clean--; Column 8, line 56, "constructed" should be --constricted--.

In the claims: Claim 7, column 9, line 45, "phase" should be --phases--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*